US007628179B2

(12) United States Patent
Mohamed

(10) Patent No.: US 7,628,179 B2
(45) Date of Patent: Dec. 8, 2009

(54) 3-D WOVEN FABRIC AND METHODS FOR THICK PREFORMS

(75) Inventor: Mansour Mohamed, Raleigh, NC (US)

(73) Assignee: 3 TEX, Inc., Cary, NC (US)

( * ) Notice: Subject to any disclaimer, the term of this patent is extended or adjusted under 35 U.S.C. 154(b) by 306 days.

(21) Appl. No.: 11/881,579

(22) Filed: Jul. 27, 2007

(65) Prior Publication Data

US 2009/0025544 A1 Jan. 29, 2009

(51) Int. Cl.

| | |
|---|---|
| ***D03D 5/00*** | (2006.01) |
| ***D03D 47/48*** | (2006.01) |
| ***D03D 13/00*** | (2006.01) |
| *D03D 41/00* | (2006.01) |
| *D03D 23/00* | (2006.01) |

(52) U.S. Cl. ..... 139/11; 139/DIG. 1; 139/383 R

(58) Field of Classification Search ..... 139/DIG. 1, 139/11, 383 R

See application file for complete search history.

(56) References Cited

U.S. PATENT DOCUMENTS

| | | | | |
|---|---|---|---|---|
| 3,834,424 | A * | 9/1974 | Fukuta et al. | 139/22 |
| 3,874,422 | A * | 4/1975 | Dow | 139/383 R |
| 5,076,330 | A * | 12/1991 | Kimbara et al. | 139/11 |
| 5,085,252 | A * | 2/1992 | Mohamed et al. | 139/22 |
| 5,137,058 | A * | 8/1992 | Anahara et al. | 139/384 R |
| 5,211,967 | A * | 5/1993 | Yasui et al. | 442/206 |
| 5,224,519 | A * | 7/1993 | Farley | 139/11 |
| 5,270,094 | A * | 12/1993 | Anahara et al. | 428/113 |
| 5,449,025 | A * | 9/1995 | Weinberg | 139/11 |
| 5,465,760 | A * | 11/1995 | Mohamed et al. | 139/11 |
| 6,105,622 | A * | 8/2000 | Sternheim et al. | 139/11 |
| 6,315,007 | B1 * | 11/2001 | Mohamed et al. | 139/11 |
| 6,521,148 | B2 * | 2/2003 | Qiu et al. | 264/46.4 |
| 6,555,488 | B1 * | 4/2003 | Qiu et al. | 442/205 |
| 6,705,354 | B2 * | 3/2004 | Yama et al. | 139/434 |
| 7,377,752 | B2 * | 5/2008 | Mohamed | 416/226 |
| 2001/0014565 | A1 * | 8/2001 | Qiu et al. | 442/221 |
| 2003/0119398 | A1 * | 6/2003 | Bogdanovich et al. | 442/204 |
| 2005/0186081 | A1 * | 8/2005 | Mohamed | 416/226 |
| 2007/0189902 | A1 * | 8/2007 | Mohamed | 416/226 |

* cited by examiner

*Primary Examiner*—Bobby H Muromoto, Jr.
(74) *Attorney, Agent, or Firm*—Triangle Patents, PLC

(57) ABSTRACT

Fabric and methods of forming thick 3-D woven preforms wherein substantially orthogonal yarn systems are manipulated in each direction to provide predetermined thickness and cross-sectional shapes.

17 Claims, 2 Drawing Sheets

3-D WOVEN FABRIC AND METHODS FOR THICK PREFORMS

BACKGROUND OF THE INVENTION (1) Field of the Invention

The present invention relates generally to weaving and, more particularly, to thick preforms or 3-D woven fabric and methods of making same.

(2) Description of the Prior Art

Prior art cross-sectional shaped 3-D fabrics require looped selvage edges to secure the filling yarns during the fabric forming process, as set forth in U.S. Pat. No. 5,085,252 issued Feb. 4, 1992 to Mohamed et al. for a Method of forming variable cross-sectional shaped three-dimensional fabrics. Also, thick 3-D woven fabrics or preforms are not generally able to be manufactured on conventional weaving machines, so conventional weaving and selvage formation were not available.

Thus, there remains a need for a 3-D fabric having non-looped selvage edges.

SUMMARY OF THE INVENTION

The present invention is directed to a 3-D fabric having non-looped selvage edges and methods of making same, in particular for thick, substantially rectangular cross-section fabrics.

Thus, the present invention provides 3-D fabrics having non-looped selvages, and methods of making same for thick, substantially rectangular cross-sectional shapes.

Accordingly, one aspect of the present invention is to provide a three-dimensional (3-D) woven fabric including: a 3-D woven fabric formed from three independent, orthogonal yarn systems and corresponding components thereof, including a warp, x-direction components; a filling, y-direction components; and a vertical, thickness, z-direction components; and selvage edges formed by the filling yarns and selvage yarns; wherein harness components for manipulating z-direction and selvage yarns provide non-looped selvage edges for securing the body of the fabric and raveling prevention.

Another aspect of the present invention is to provide a method for weaving a three-dimensional fabric having a predetermined substantially rectangular cross-sectional shape and substantial thickness according to the present invention including the steps of:

a. providing at least one layer of warp yarns which are in horizontal and vertical alignment and maintained under tension, the layers of warp yarns defining a predetermined cross-sectional shape;
b. selectively inserting a plurality of weft yarns which are secured in place by selvage yarn components at the respective fore ends thereof into spaces between the layers of warp yarn, the weft yarns being alternately or simultaneously inserted a predetermined distance from opposing sides of the warp yarn cross-sectional shape in accordance with the rectangular shape of the fabric being formed, the weft yarns from each side of the warp yarn cross-sectional rectangular shape being inserted at substantially uniform horizontal distances;
c. bringing a reed into contact with the fell of the fabric being formed;
d. inserting vertical yarns into spaces between vertical rows of the warp yarns in a direction substantially perpendicular to both the warp and weft yarns, the vertical yarns being selectively threaded through a plurality of harnesses so as to be separated into a predetermined plurality of vertically movable yarn systems by the harnesses in accordance with the shape of the fabric being formed, and the yarn systems being selectively vertically moved by the harnesses to insert the vertical yarns into the fabric; and
f. repeating the steps (a)-(d) after insertion of the vertical yarns.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
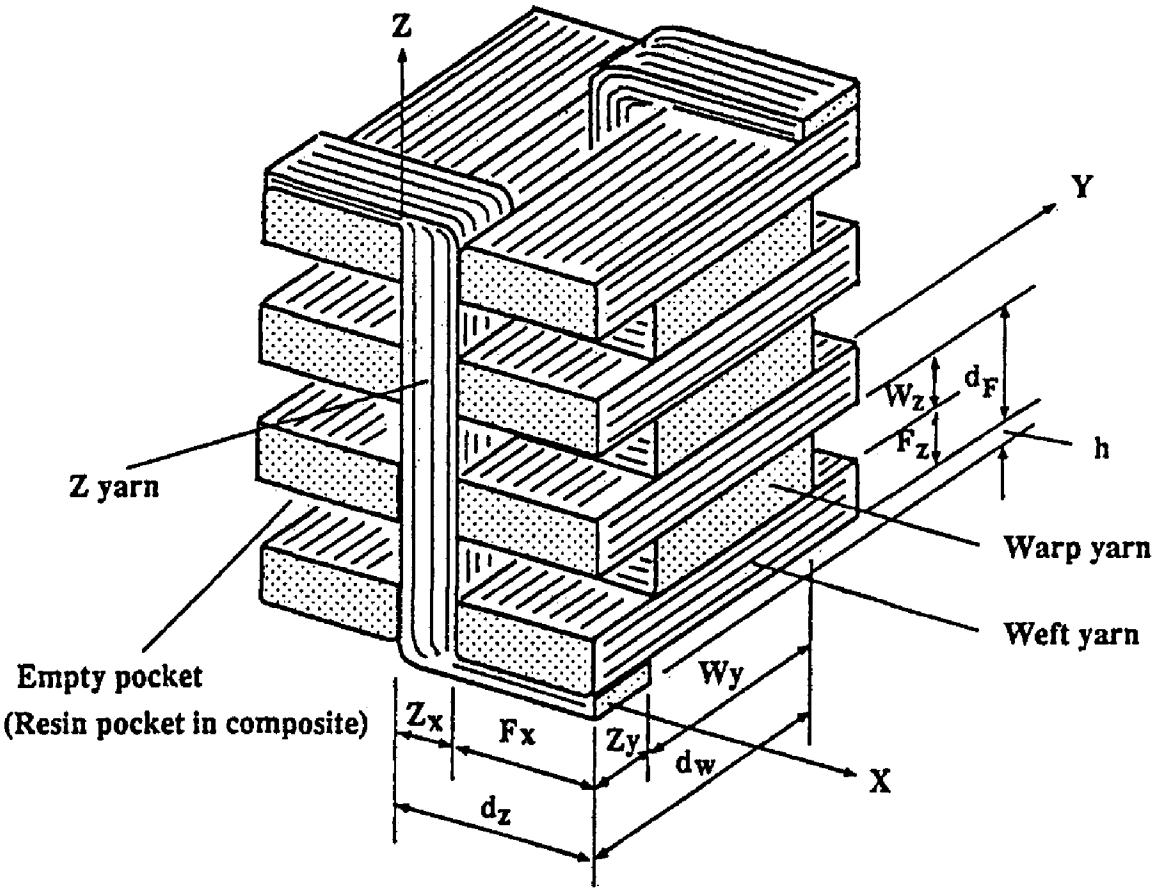
FIG. 1 is a perspective view of a fabric body constructed according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Referring now to the drawings in general, the illustrations are for the purpose of describing a preferred embodiment of the invention and are not intended to limit the invention thereto.

3-D woven fabrics or preforms having a substantial thickness and, preferably having non-looped selvages constructed and configured according to the present invention are preferably formed with substantially rectangular cross-sectional shapes and with a relatively thick z-direction dimension, when compared to prior art 3-D woven fabrics. 3-D woven fabrics are known in the prior art, in particular being formed according to methods set forth in U.S. Pat. No. 5,085,252 issued Feb. 4, 1992 to Mohamed et al. for a Method of forming variable cross-sectional shaped three-dimensional fabrics, which is incorporated herein by reference in its entirety.

As best seen in FIG. 1, a 3-D fabric is shown having three substantially orthogonal yarn component systems in x-, y-, and z-directions, wherein the z-direction establishes the "thickness" dimension of the embodiments. The present invention provides for a thick perform or 3-D woven fabric and methods of making the same, the fabric having a plurality of orthogonal yarn systems and corresponding yarn components thereof, including at least three directional systems: a warp, or x-direction; a filling, or y-direction; and a substantial vertical or thickness dimension corresponding to a z-direction, which are inserted into the fabric by reciprocation of a plurality of harnesses that separate and direct movement of the z-direction yarns by creating opposing groups for securing the warp and filling yarn systems in place with respect to each other, the entire fabric and its plurality of orthogonal yarn systems being secured at edges along the width of the fabric with respect to the fabric forming machine by selvage edges formed by interplacing the filling yarns with selvage yarns whose movement is independently directed by corresponding harnesses to create at least two opposing, compressive forces by selvage yarns against the thickness of filling and warp yarns forming the fabric body along regions at the fabric edges.

Figure 2:
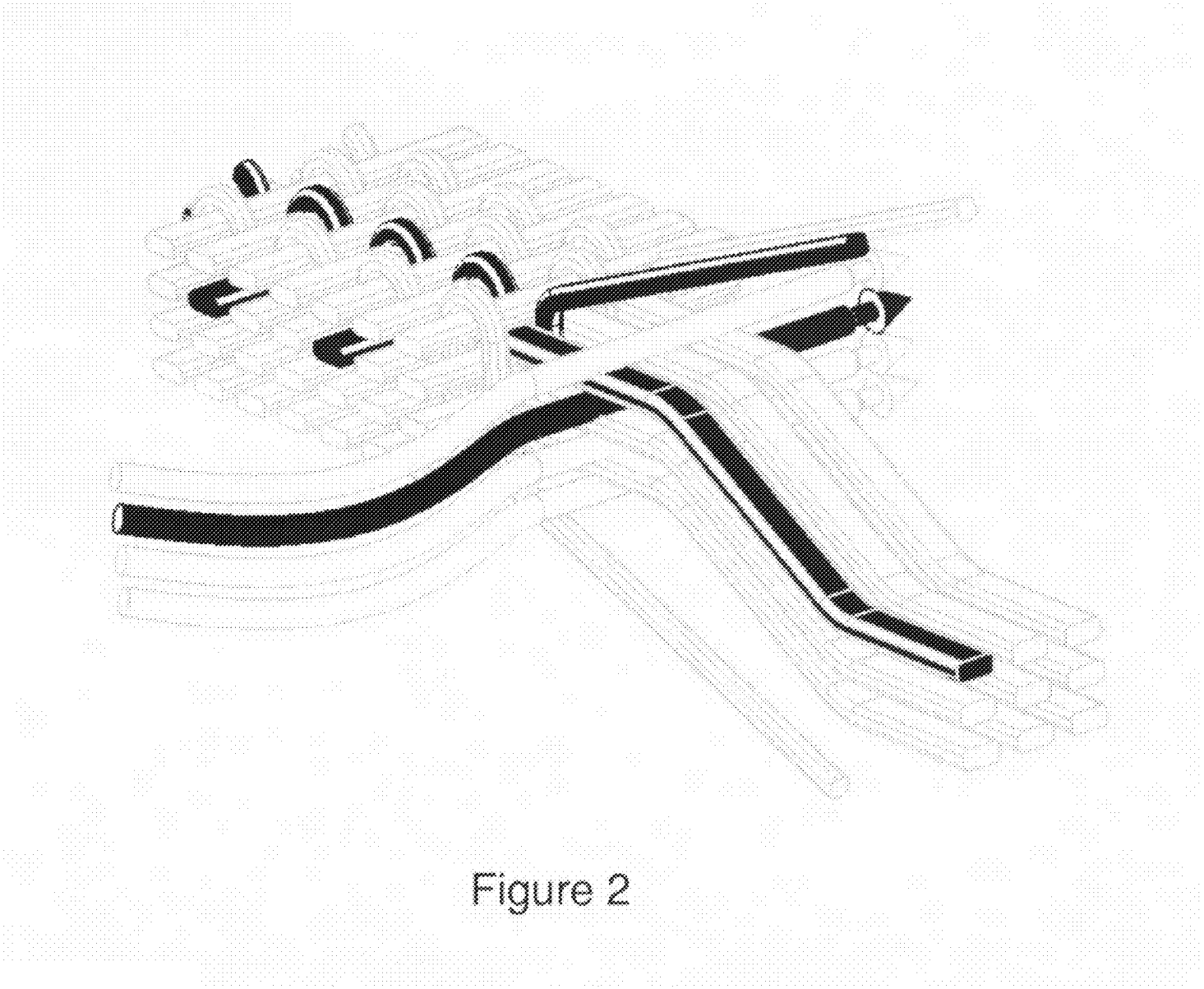
FIG. 2 illustrates shed openings and yarn systems for thick 3-D fabric formation.

The harness components are designed, constructed and positioned within the fabric forming machine for manipulating z-direction and selvage yarns such that the z-yarns form compressive forces against the collection of warp and filling yarns of the fabric body, thereby securing them in position with respect to each other, which is exceptionally difficult for forming selvage edges for thick preforms. FIG. 2 illustrates shed openings and yarn systems for 3-D weaving of fabrics.

Significantly, by contrast to the prior art 3-D woven fabrics, and uniquely for thick preforms, it is preferred that the selvage edges are formed with non-looped selvage edges, whereas the prior art cross-sectional shaped 3-D fabrics required looped selvage edges to secure the filling yarns during the fabric forming process, as set forth in U.S. Pat. No. 5,085,252 issued Feb. 4, 1992 to Mohamed et al. for a Method of forming variable cross-sectional shaped three-dimensional fabrics. In a preferred embodiment of the present invention, the 3-D fabric is formed with a substantially rectangular cross-sectional shape having a substantial thickness between about 0.1 inches and about 10 inches preferably between about 0.1 inches and about 6 inches. This will depend upon the size of the tow and the number of layers. The machine will accommodate up to 60 filling layers, which establishes the substantial thickness in the z-direction dimension, thus providing for substantially thick preforms. The corresponding thickness dimension can be formed with such a machine less than about 1 inch to 8 inches, preferably more than one inch to about 8 inches thick, depending upon the size of the tow. Ranges of tow: between about 1000 in a single or plural arrangement at each position to about 60,000. Different motions of z-direction yarns may be needed to affect the shed opening of about 40 to about 48 inches at the harness area.

Methods of making the non-looped selvage edge substantially rectangular thick 3-D orthogonal fabric preforms according to the present invention generally follow the methods set forth in the prior art U.S. Pat. No. 5,085,252, which methods are incorporated herein by reference, with the important distinction of the looped filling selvage edges, which are required for forming the variable cross-sectional shaped 3-D fabrics set forth therein. While looped filling selvage edges provide for securement of the yarn systems forming the fabric in a 3-D structure, they create thickness variation and fabric differences at the edges that affect a region into the fabric body, which introduces non-uniformities into products made from such fabrics with looped selvage edges. Traditional selvage edges are retained with a fabric through later processing to prevent raveling. With thick 3-D orthogonal fabrics, a secure selvage is critical, not merely for later processing, but for providing consistent, uniform qualities of any composite material made from the fabric perform. Surprisingly, the looped edge selvages, while providing securement, create non-uniformities that produce significant waste and cost disadvantages associated with thick 3-D performs. Thus, the present invention provides a non-looped selvage edge specially designed for thick 3-D preforms to ensure securement of the filling or y-direction yarns or components, in particular for substantially rectangular cross-sectional shapes for the warp or x-direction yarns or components.

The 3-D, thick fabric formed in a substantially rectangular cross-section is preferably formed on a machine designed for producing the thick, 3-D fabrics; however, depending upon the thickness specified, the fabric may also be formed on another machine designed for producing a high speed three-dimensional woven fabric structure comprising a modified rapier weaving loom configured to provide the 3-D fabric having at least one warp yarn system having approximately zero crimp;

at least two filling insertions per insertion cycle, wherein each filling insertion includes a filling yarn pair having approximately zero crimp, and wherein the warp and filling insertions are positioned in alternating, orthogonal layers and the warp and filling insertions are non-interlacing with each other;

at least one vertical or Z yarn system provided via at least two harness frames that are moved to secure the warp and filling yarns to form an integral fabric; whereby each of the at least two filling yarn pairs in a filling insertions is introduced within a unique shed opening to form a complete filling insertion cycle without advancing the X-direction warp yarns by adjusting the warp yarn system drums and a take-up roll in coordinated rotational movement until a filling insertion cycle is completed;

a tension system for advancing the warp yarn systems at a predetermined rate coordinated with a take-up for fabric, wherein the take-up and warp advance is activated at the completion of a filling insertion cycle, which is half a fabric pattern repeat cycle, thereby providing a machine for formation of a 3-dimensional woven fabric at high speed and large dimensions.

In the case of the high-speed option, the method of making the 3-D woven fabric on a high speed three-dimensional weaving machine includes the steps providing at least one X-direction warp yarn systems drawn through at least 2 harnesses having approximately zero crimp and at least two Y-direction filling insertions including a pair of filling yarns in each insertion having approximately zero crimp, wherein the warp and filling yarns are non-interlacing with each other;

introducing each of the at least two filling insertions in series, each introduced within a unique shed opening and separated by a plane of X-direction warp yarns, the insertions forming a substantially vertical alignment with each other completing a filling insertion cycle without advancing the X-direction warp yarns advancing a reed in a beat-up motion toward a fabric being formed by the yarns, wherein each filling insertion is followed by the reed beat-up and changing the position of the X-direction harnesses controlling the X-direction warp yarns to form a new shed opening;

changing the position of the Z-direction yarns by moving the Z-direction harnesses to cross each other from top to bottom and vice versa;

advancing the warp yarn systems at a predetermined rate coordinated with a fabric take-up rate securing the X-direction warp yarns and Y-direction filling insertions together an integral fabric via at least one vertical or Z yarn system provided via two harness frames;

repeating the previous steps, thereby forming a 3-dimensional orthogonal woven fabric. In the methods of fabric formation, the filling insertion may be made from one side only or from both sides in an alternating or simultaneous manner. The warp yarn layers may from a predetermined variable cross-section or a substantially rectangular or orthogonal shape.

Additional steps or features of this high-speed weaving option may include:

the structure having at least three yarn systems, one each in an X, Y, and Z direction, thereby forming a substantially orthogonal 3-D woven structure;

structure is formed from at least one high performance fiber type;

the structure being formed using at least two Z-direction harnesses for controlling the Z-direction yarn positions to form the unique shed opening for each filling insertion cycle;

the structure being formed using at least two Z-direction harnesses for controlling the Z-direction yarn positions to form the unique shed opening for each filling insertion the fabric dimensions including a Y-direction width between about 1 to about 72 inches wide or even wider;

Y-direction layers are at least two layers and the X-direction layers are at least one layer;

Y-direction layers are four layers and the X-direction layers are three layers;

Y-direction filling insertions are made at a speed between about 150 to about 350 Y-direction insertions per minute;

Y-direction filling-insertions are made at a speed between about 250 to about 300 Y-direction insertions per minute.

In particular, the high-speed weaving method may further include the steps of providing the Z-direction yarns in two harnesses Z1, Z2 and the X-direction yarns in harnesses W1 and W2;

positioning the Z-direction yarns in harness Z1 and the X-direction yarns in harnesses W1 and W2 in an UP position and the Z-direction yarns in harness Z2 in a DOWN position thereby forming a first open shed for the introduction of a first Y-direction filling insertion F1;

inserting the Y-direction filling insertion yarns F1 via a rapier system across the width of the weaving machine and cutting each end of the Y-direction filling insertion to form a finite filling insertion F1;

activating a reed beat-up against the fabric being formed by the yarns;

positioning the Z-direction yarn in harness Z1 and the X-direction yarns in harnesses W2 in an UP position, and positioning the Z-direction yarn in harness Z2 and the X-direction yarns in harnesses W1 in a DOWN position to form a second open shed for the introduction of a second Y-direction filling insertion F2;

inserting the second Y-direction filling insertion F2 via a rapier system across the width of the weaving machine and cutting each end of the Y-direction filling insertion to form a finite filling insertion F2;

activating a reed beat-up against the fabric being formed by the yarns;

positioning the Z-direction yarn in harness Z1 in an UP position and positioning the Z-direction yarn in harness Z2 and the X-direction yarns in harnesses W1 and W2 in a DOWN position to form an open shed for the introduction or insertion of the third Y-direction filling insertion yarns F3;

inserting a third Y-direction filling insertion F3 via a rapier system across the width of the weaving machine and cutting each end of the Y-direction insertions filling insertion to form a finite filling insertion F3;

activating a reed beat-up against the fabric being formed by the yarns;

activating warp advance and coordinated take-up of fabric after the completion of the filling insertion cycle including completed filling insertion of the first, second, and third filling insertion in a spaced-apart, approximately perfectly stacked or vertically aligned position within the fabric;

reversing the positions of the Z-direction harnesses Z1 and Z2;

positioning the Z-direction yarn in harness Z2 in the UP position and positioning the Z-direction yarn in harness Z1 and the X-direction yarns in harnesses W1 and W2 in the DOWN position to form an open shed for the introduction of the fourth Y-direction filling insertion F4;

inserting the fifth Y-direction filling insertion F5 via a rapier system across the width of the weaving machine and cutting each end of the Y-direction filling insertion to form a finite filling insertion F5;

activating a reed beat-up against the fabric being formed by the yarns;

positioning the Z-direction yarn in harness Z2 and the X-direction yarns in harnesses W1 and W2 in the UP position and the Z-direction yarn in harness Z1 in a DOWN position to form an open shed for the introduction or insertion of the sixth Y-direction filling insertion F6 inserting the sixth Y-direction filling insertion F6 via a rapier system across the width of the weaving machine and cutting each end of the Y-direction filling insertions to form a finite filling insertion F6 activating a reed beat-up against the fabric being formed by the yarns activating warp advance and coordinated take-up of fabric after the completion of the filling insertion cycle including completed filling insertion of the fourth, fifth, and sixth filling insertion in a spaced-apart, vertically aligned position within the fabric reversing the positions of the Z-direction harnesses Z1 and Z2; repeating the fabric repeat cycle, which includes all of the steps listed herein.

The present invention further provides for methods of forming substantially rectangular cross-sectional shaped three-dimensional fabrics, preferably of significant thickness. Significantly, the present invention provides for approximately or substantially perfect stacking or vertical alignment of the Y-direction yarns within the structure, due to the insertion method and structure of the fabric for thick preforms, which is not possible in the prior art.

One method for weaving a three-dimensional fabric having a substantially rectangular cross-sectional shape includes the steps of:

a. providing a plurality of layers of warp yarns which are in horizontal and vertical alignment and maintained under tension, the layers of warp yarns defining a substantially rectangular cross-sectional shape;

b. selectively inserting a plurality of parallel weft or filling yarns into spaces between the layers of warp yarn, the parallel weft yarns being inserted a predetermined substantially uniform horizontal distance from at least one side of the warp yarn cross-sectional shape in accordance with the shape of the fabric being formed;

c. weaving selvage yarn with the weft yarns to secure them at the edges of the warp yarn cross-sectional shape;

d. bringing a reed into contact with the fell of the fabric being formed e. inserting vertical yarns into spaces between vertical rows of the warp yarns in a direction substantially perpendicular to both the warp and the parallel weft yarns, the vertical yarns being selectively threaded through a plurality of harnesses so as to be separated into a predetermined plurality of vertically movable yarn systems by the harnesses in accordance with the shape of the fabric being formed, and the yarn systems being selectively vertically moved by the harnesses to insert the vertical yarns into the fabric;

f. forming a three-dimensional fabric by repeating the steps (a)-(e) after insertion of the vertical yarns.

Additional options or variations on the methods of the present invention further include:

the weft yarns are simultaneously inserted from both sides of the warp yarn cross-sectional shape.

the weft yarns from one side of the warp yarn cross-sectional shape are inserted different horizontal distances than the weft yarns from the other side of the warp yarn cross-sectional shape.

the weft yarns from each side of the warp yarn cross-sectional shape are inserted non-uniform horizontal distances.

the weft yarns are alternately inserted from opposing sides of the warp yarn cross-sectional shape.

the selvage yarn is interwoven with the fore end of the weft yarns in a predetermined pattern.

One method for weaving a three-dimensional fabric having a thick, substantially rectangular cross-sectional shape includes the steps of:

a. providing a plurality of layers of warp yarns which are in horizontal and vertical alignment and maintained under tension, the layers of warp yarns defining a variable predetermined cross-sectional shape;

b. selectively inserting a plurality of weft yarns which are secured by a selvage at the respective fore ends thereof into spaces between the layers of warp yarn, the weft yarns being simultaneously inserted a predetermined and differential horizontal distance from both sides of the warp yarn cross-sectional shape in accordance with the shape of the fabric being formed;

c. weaving selvage yarn with the weft yarns d. bringing a reed into contact with the fell of the fabric being formed;

e. inserting vertical yarns into spaces between vertical rows of the warp yarns in a direction substantially perpendicular to both the warp and weft yarns, the vertical yarns being selectively threaded through a plurality of harnesses so as to be separated into a predetermined plurality of vertically movable yarn systems by the harnesses in accordance with the shape of the fabric being formed, and the yarn systems being selectively vertically moved by the harnesses to insert the vertical yarns into the fabric; and f. repeating the steps (a)-(e) after insertion of the vertical yarns.

According to the present invention, one method for weaving a three-dimensional fabric having a substantially rectangular cross-sectional shape includes the steps of:

a. providing a plurality of layers of warp yarns which are in horizontal and vertical alignment and maintained under tension, the layers of warp yarns defining a substantially rectangular cross-sectional shape;

b. selectively inserting singularly or a plurality of filling yarns which are connected or secured by interweaving a selvage at the respective fore ends thereof into spaces between the layers of warp yarn, the filling yarns being simultaneously inserted a predetermined, substantially similar horizontal distance from both sides of the warp yarn cross-sectional shape in accordance with the shape of the fabric being formed, the weft yarns from one side of the warp yarn cross-sectional shape being inserted substantially similar horizontal distances than filling yarns from the other side;

c. interweaving selvage yarn with the fore ends of the filling yarns;

d. bringing a reed into contact with the feel of the fabric being formed;

e. inserting vertical yarns into spaces between vertical rows of the warp yarns in a direction substantially perpendicular to both the warp and filling yarns, the vertical yarns being selectively threaded through a plurality of harnesses so as to be separated into a predetermined plurality of vertically movable yarn systems by the harnesses in accordance with the shape of the fabric being formed, and the yarn systems being selectively vertically moved by the harnesses to insert the vertical yarns into the fabric;

f. repeating the steps (a)-(e) after insertion of the vertical yarns;

One embodiment of the present invention provides a method for weaving a three-dimensional fabric having a substantially rectangular cross-sectional shape includes the steps of:

a. providing a plurality of layers of warp yarns which are in horizontal and vertical alignment and maintained under tension, the layers of warp yarns defining a substantially rectangular cross-sectional shape;

b. selectively inserting a plurality of weft or filling yarns which are connected by a loop at the respective fore ends thereof into spaces between the layers of warp yarn, the filling yarns being alternatively inserted a predetermined and differential horizontal distance from opposing sides of the warp yarn cross-sectional shape in accordance with the shape of the fabric being formed, the filling yarns from one side of the warp yarn cross-sectional shape being inserted substantially similar horizontal distances than filling yarns from the other side;

c. threading selvage yarn through the loops at the fore ends of the weft yarns;

d. bringing a reed into contact with the feel of the fabric being formed;

e. inserting vertical yarns into spaces between vertical rows of the warp yarns in a direction substantially perpendicular to both the warp and filling yarns, the vertical yarns being selectively threaded through a plurality of harnesses so as to be separated into a predetermined plurality of vertically movable yarn systems by the harnesses in accordance with the shape of the fabric being formed, and the yarns systems being selectively vertically moved by the harnesses to insert the vertical yarns into the fabric;

f. repeating the steps (a)-(e) after insertion of the vertical yarns

A method for weaving a three-dimensional (3-D) fabric having a predetermined, substantially rectangular cross-sectional shape includes the steps of:

a. providing a plurality of layers of warp yarns which are in horizontal and vertical alignment and maintained under tension, the layers of warp yarns defining a predetermined substantially rectangular cross-sectional shape;

b. selectively inserting a plurality of weft yarns which are secured by selvage yarn components at the respective fore ends thereof into spaces between the layers of warp yarn, the weft yarns being simultaneously inserted a predetermined and differential horizontal distance from both sides of the warp yarn cross-sectional shape in accordance with the shape of the fabric being formed, the weft yarns from each side of the warp yarn cross-sectional shape being inserted at substantially uniform horizontal distances;

c. threading selvage yarn through the loops at the fore ends of the weft yarns;

d. bringing a reed into contact with the fell of the fabric being formed;

e. inserting vertical yarns into spaces between vertical rows of the warp yarns in a direction substantially perpendicular to both the warp and weft yarns, the vertical yarns being selectively threaded through a plurality of harnesses so as to be separated into a predetermined plurality of vertically movable yarn systems by the harnesses in accordance with the shape of the fabric being formed, and the yarn systems being selectively vertically moved by the harnesses to insert the vertical yarns into the fabric; and f. repeating the steps (a)-(e) after insertion of the vertical yarns.

Another method for weaving a three-dimensional fabric having a predetermined substantially rectangular cross-sectional, shape according to the present invention includes the steps of:

a. providing a plurality of layers of warp yarns which are in horizontal and vertical alignment and maintained under tension, the layers of warp yarns defining a variable predetermined cross-sectional shape;

b. selectively inserting a plurality of weft yarns which are secured in place by selvage yarn components at the respective fore ends thereof into spaces between the layers of warp yarn, the weft yarns being alternately or simultaneously inserted a predetermined distance from opposing sides of the warp yarn cross-sectional shape in accordance with the rectangular shape of the fabric being formed, the weft yarns from each side of the warp yarn cross-sectional rectangular shape being inserted at substantially uniform horizontal distances;

c. bringing a reed into contact with the fell of the fabric being formed;

d. inserting vertical yarns into spaces between vertical rows of the warp yarns in a direction substantially perpendicular to both the warp and weft yarns, the vertical yarns being selectively threaded through a plurality of harnesses so as to be separated into a predetermined plurality of vertically movable-yarn systems by the harnesses in accordance with the shape of the fabric being formed, and the yarn systems being selectively vertically moved by the harnesses to insert the vertical yarns into the fabric; and f. repeating the steps (a)-(d) after insertion of the vertical yarns.

Thick 3-D Fabrics

Once manufacturing 3-D fabrics having a thickness in the z-direction of greater than about one inch thick, and preferably, at least two (2) inches thick, or more than about 7 layers of y-direction or filling yarns are used, then modification of the z-yarn is required to ensure uniformity, in particular with modified selvage edges according to the present invention.

Because of the extent of the shed opening, the z-yarn crosses and shifts forward, more difficult to insert filling and resistance to beat-up increases as well. This requires z-shed modification, which is an essential part of thick perform 3-D weaving, and a key factor in fabrics and methods according to the present invention.

A needle is used to holding the y-direction yarn; looped selvage is knitted or looped ends are used in the z-direction yarns. The knitted selvage or the knitting operation in the selvage is thus eliminated with the product and methods of the present invention for thick 3-D fabrics.

Continuous filling (turns around and forms a loop); the thicker the fabric, the more difficult it is to do any leno work. The z-yarn is weaving, not looping or knitting. But the filling hold is depended upon to maintain the edge. The better controlled edge, i.e., the edge having less extended loops is the edge from which the filling is inserted. At least two additional z-yarns are used by weaving to form the selvage in one case, i.e., in addition to any last or edge z-yarn, at least two extra z-yarns are introduced. The weaving pattern is preferably the same, but could follow a different pattern as the body z-yarn.

If cutting after each insertion, use leno selvage.

Commercial Minimums:

One (1) warp layer, one z-layer, and two (2) filling layers, which is a very thin 3-D fabric, is also produced according to the present invention. Applications for this embodiment include, but are not limited to, marine helmets, and the like. Any applications for fabrics and composites using fabrics as a thin reinforcement, with advantages of reduced crimp for increased stability.

Stacking

Perfectly stacked yarns are used in the fabric body to form the channels. This differentiates 3TEX's materials from anything else where picks are inserted sequentially or simultaneously. The Filling yarns or y-direction filling yarns are precisely inserted to create exact vertical stacking of the y-direction yarns in the thickness or z-direction of the fabric.

An example follows for Machine/Process Modification:

Machine/Process Modification

The process of fabric formation on the conventional weaving machine (called 2D weaving) is characterized by the interlacing of the warp and filling at right angles. The formation of the fabric is accomplished by beating-up of the inserted filling yarn (after or before shed change) by the reed to the point of fabric formation, which is called fabric fell. The formed fabric is taken up without changing the position of the fabric fell on the machine. For a certain fabric construction the fabric take-up and warp let-off are adjusted to keep the fabric fell in position during the fabric formation. The geometry of the warp shed depends to a large extent on the distance between the fabric fell and the shed height at the reed.

In the thick perform 3-D weaving, multiple warp layers and multiple filling insertions are intersected at right angles and the Z-yarn binds them. This fabric formation is significantly different from that known in conventional weaving due to the process of producing three-dimensional fabric. While the filling beat-up, fabric take-up and warp let-off are still the same as in conventional weaving, the multiple sheds and filling insertions resulted in the different shed geometry from that known in 2D weaving. The shed geometry becomes very critical when weaving large numbers of layers to produce thick perform. The fabric fell consists of multiple filling yarns, which becomes impossible to hold in position even after shed change due to the same geometry. The first trial of weaving resulted in a C perform with thickness of 2.3 inch and loops at both sides.

The filling loops formed at the insertion side were found to be different in length depending on their position relative to the center of the shed. The loop length increases as the filling distance from the center goes up.

The filling loops at the selvedge side are also different in length. This is because the center filling yarns are pulled back when the next insertion has taken place due to the loose fabric fell. This also resulted in variation in perform thickness along the width.

The measured thickness was ~2.3 inch. Variation of thickness along the perform width has been observed.

The crude in-house composite and cross-sections showed that the Z-yarn was not binding the warp and filling layers at right angle. The Z-yarn showed a bow shape with maximum deflection in the center in both planes (XZ and YZ). The optical quality of these cross-sections was poor and images were not attempted. However, the basic tow structure was visible to the naked eye.

The analysis of the results showed that the geometry of the sheds formed by the Z-yarns and warp layers is attributed to these problems which affected the perform internal structure. To solve these problems the following steps have been made and implemented with a machine and methods of making the thick 3-D fabrics according to the present invention:

1. A holding mechanism was developed for the filling loops at the selvedge side, which prevented the pulling back of the filling yarn when the next insertion has taken place. This mechanism holds the loops after securing it from slippage to hold the next set of loops.
2. To overcome the edge problem of the insertion side, it was found that widening or extending the Z-yarn shed opening (top and bottom Z-yarns sheds) made a major impact on the ease of weaving and selvedge formation. This widening was done by manually inserting two needles and holding the Z-yarns open. These needles are withdrawn from the sheds as soon as filling insertion is complete and the reed is about to move forward (manual operation). The geometry of the sheds improved due to the securing the fabric fell. The improved shed geometry is demonstrated in FIG. 3.

The perform resulting from the modified, thick 3-D weaving process according to the present invention improved in terms of the uniformity of the thickness, which was found to be ~1.97 inch with clean neat edges. There appeared to be significantly less non-uniformity, with any existing being due to some manual operation and inconsistency of the position and timing of putting the needles for the test case or example. Based on the experience to date, it is clear from the experimentation this modified process as in the present invention is essential for all thick 3-D weaving, i.e. larger than ~1 inch, or greater than ~8-10 layers.

Certain modifications and improvements will occur to those skilled in the art upon a reading of the foregoing description. All modifications and improvements have been deleted herein for the sake of conciseness and readability but are properly within the scope of the following claims.

What is claimed is:

1. A three-dimensional (3-D) woven fabric comprising:

a 3-D woven fabric formed from three independent, orthogonal yarn systems and corresponding components thereof, including a warp, x-direction components; a filling, y-direction components; and a vertical, thickness, z-direction components; and selvage edges formed by the filling yarns and selvage yarns; wherein the z-direction and selvage yarns provide non-looped selvage edges for securing the body of the fabric and raveling prevention; wherein the thickness is greater than about one inch;

and wherein the y-direction components are substantially perfectly vertically aligned with respect to each other.

2. The fabric of claim 1, wherein the body of the fabric forms a substantially rectangular cross-sectional shape.

3. The fabric of claim 1, wherein the fabric has a thickness between about 0.01" and about 10".

4. The fabric of claim 1, wherein the selvage is formed without requiring any looping of the filling, y-direction components.

5. A method for weaving a three-dimensional fabric having a predetermined substantially rectangular cross-sectional shape according to the present invention comprising the steps of:

a. providing a plurality of layers of warp yarns which are in horizontal and vertical alignment and maintained under tension, the layers of warp yarns defining a predetermined cross-sectional shape;

b. selectively inserting a plurality of weft yarns which are secured in place in substantially perfect vertical alignment with respect to each other by selvage yarn components at the respective fore ends thereof into spaces between the layers of warp yarn, the weft yarns being alternately or simultaneously inserted a predetermined distance from opposing sides of the warp yarn cross-sectional shape in accordance with the rectangular shape of the fabric being formed, the weft yarns from each side of the warp yarn cross-sectional rectangular shape being inserted at substantially uniform horizontal distances;

c. bringing a reed into contact with the fell of the fabric being formed;

d. inserting vertical yarns into spaces between vertical rows of the warp yarns in a direction substantially perpendicular to both the warp and weft yarns, the vertical yarns being selectively threaded through a plurality of harnesses so as to be separated into a predetermined plurality of vertically movable yarn systems by the harnesses in accordance with the shape of the fabric being formed, and the yarn systems being selectively vertically moved by the harnesses to insert the vertical yarns into the fabric, wherein the selvage is formed without requiring any looping of the filling, y-direction components; and e. repeating the steps (a)-(d) after insertion of the vertical yarns to form a 3-D fabric having a thickness of greater than about one inch.

6. The method of claim 5, wherein the selvage is interwoven with the filling by a predetermined pattern.

7. The method of claim 5, wherein the weft yarns are simultaneously inserted from both sides of the warp yarn cross-sectional shape.

8. The method of claim 5, wherein the weft yarns from one side of the warp yarn cross-sectional shape are inserted at substantially similar horizontal distances as the weft yarns from the other side of the warp yarn cross-sectional shape.

9. The method of claim 5, wherein the weft yarns from each side of the warp yarn cross-sectional shape are inserted at uniform horizontal distances.

10. The method of claim 5, wherein the weft yarns are alternately inserted from opposing sides of the warp yarn cross-sectional shape.

11. The method of claim 5, wherein the selvage yarn secures the weft yarns in a predetermined pattern that provides for perfect vertical alignment with respect to each other.

12. The method of claim 5, wherein the weft yarns are inserted from only one side of the warp yarn cross-section.

13. The method of claim 5, wherein the layers of warp yarns define a substantially orthogonal shape.

14. The method of claim 5, wherein the layers of warp yarns define a variable predetermined shape.

15. A three-dimensional (3-D) woven fabric comprising:

a 3-D woven fabric formed from three independent, orthogonal yarn systems and corresponding components thereof, including a warp, x-direction components; a filling, y-direction components; and a vertical, thickness, z-direction components; and selvage edges formed by the filling yarns and selvage yarns; wherein the z-direction and selvage yarns provide non-looped selvage edges for securing the body of the fabric and raveling prevention; and wherein the y-direction components are substantially perfectly vertically aligned with respect to each other.

16. The fabric of claim 15, wherein the body of the fabric forms a substantially rectangular cross-sectional shape.

17. The fabric of claim 15, wherein the selvage is formed without requiring any looping of the filling, y-direction components.

* * * * *